US006668840B1

(12) United States Patent
Mugge et al.

(10) Patent No.: US 6,668,840 B1
(45) Date of Patent: Dec. 30, 2003

(54) APPARATUS FOR HAIRSTYLING BY MEANS OF STEAM

(75) Inventors: Jan Mugge, Drachten (NL); Lippe Van Den Brug, Drachten (NL); Peter Rijskamp, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/615,881

(22) Filed: Jul. 13, 2000

(30) Foreign Application Priority Data

Jul. 14, 1999 (EP) ..... 99202325

(51) Int. Cl.[7] ..... A45D 6/06; A45D 19/16

(52) U.S. Cl. ..... 132/228; 132/272

(58) Field of Search ..... 132/228, 229, 132/269, 268, 227, 232, 272

(56) References Cited

U.S. PATENT DOCUMENTS 2,510,664 A * 6/1950 Shield ..... 132/228
3,921,648 A * 11/1975 Barradas ..... 132/228
4,166,473 A 9/1979 Bauer et al. ..... 132/9
4,565,204 A * 1/1986 Skovdal ..... 132/228
5,494,058 A * 2/1996 Chan ..... 132/228
5,660,191 A * 8/1997 Bontoux et al. ..... 132/211

FOREIGN PATENT DOCUMENTS

FR 2726163 A1 5/1996 ..... A45D/1/00

* cited by examiner

*Primary Examiner*—John J. Wilson
*Assistant Examiner*—Robyn Kiey Doan
(74) *Attorney, Agent, or Firm*—Ernestine C. Bartlett

(57) ABSTRACT

Apparatus for hairstyling by means of steam, having a winding part (1) which extends longitudinally for winding the hair around, which winding part (1) comprises a heating element (2) which extends longitudinally, an evaporation channel (5) which extends longitudinally and has an exit (40) and is in thermal contact with the heating element (2), a steam outlet (10) which extends longitudinally, and a distribution space which connects the exit (40) of the evaporation channel (5) to the steam outlet (10). The distribution space is formed by a number of longitudinally extending distribution channels (6) which are made of a thermally conducting material and are in close thermal contact with the heating element (2) along substantially their entire length. In this way, dripping of water from the apparatus during use in varying positions is prevented.

13 Claims, 5 Drawing Sheets

APPARATUS FOR HAIRSTYLING BY MEANS OF STEAM

BACKGROUND OF THE INVENTION

The invention relates to an apparatus for hairstyling by means of steam with a winding part extending in a longitudinal direction around which the hair can be wound, which winding part comprises:

a heating element extending in the longitudinal direction;

an evaporation channel for generating steam, extending in the longitudinal direction, having an exit, and being in thermal contact with the heating element;

a steam outlet extending in the longitudinal direction; and a distribution space which connects the exit of the evaporation channel to the steam outlet.

Such an apparatus is known from U.S. Pat. No. 4,166,473.

The known apparatus comprises an evaporation channel formed as a helically curved channel around an elongate heating element in the winding part. The exit of the evaporation channel is in communication with the distribution space. The distribution space is formed by an annular chamber which is bounded by an inner wall of the winding part and an outer wall of the heating element. This annular chamber forms a connection between the exit of the evaporation channel and the steam outlet, the latter being formed by a number of openings in a wall of the winding part arranged in the longitudinal direction. These openings are in contact with the hair wound around the winding part during operation.

A quantity of steam is generated through heating of a quantity of water in the evaporation channel which is in thermal contact with the heating element when a user introduces this quantity of water through an input of said helically curved evaporation channel during operation. Said quantity of steam enters the annular chamber through the exit of the evaporation channel and subsequently passes through openings in the wall of the winding part, thus coming into contact with the hair wound around the winding part. This known apparatus realizes the hairstyling operation by means of steam which is applied to the hair in a pulsatory manner.

It is a disadvantage of the known apparatus that drops of water can leak along with the steam from the winding part through the openings to the exterior during operation. Water drops leaking from the winding part during hairstyling may drop onto the skull through the wound lock of hair and thus be unpleasant for the user, indeed, drops of a certain temperature may even be dangerous for the user. In addition, water drops may adversely affect an optimized, homogeneous application of steam to the lock of hair which is necessary for a satisfactory hairstyling result.

SUMMARY OF THE INVENTION

It is an object of the invention to provide an apparatus of the kind mentioned in the opening paragraph which is improved as regards its comfort of use, safety, and hairstyling result.

The above object is achieved with the apparatus according to the invention which is characterized in that the distribution space comprises a distribution channel which extends in the longitudinal direction, which is manufactured from a thermally conducting material, and which is in thermal contact with the heating element over substantially its entire length.

The fact that the distribution channel is manufactured from a thermally conducting material and is in thermal contact with the heating element over substantially its entire length means that the distribution channel is at a comparatively high temperature during operation. Condensation of the steam in the distribution channel is counteracted thereby. Leaking of water drops from the winding part onto the user's head is counteracted in this manner in various operational positions of the apparatus, which benefits the safety of the apparatus. It is furthermore counteracted that drops could interfere with the desired homogeneous application of steam to the lock of hair wound around the winding part.

An embodiment of the apparatus according to the invention is characterized in that the evaporation channel extends from adjacent a base of the winding part to adjacent an end of the winding part, and the distribution channel extends from adjacent said end to adjacent said base. The apparatus thus has a compact shape, while the evaporation channel and the distribution channel are nevertheless both in thermal contact with the heating element. A compact shape offers the possibility of achieving a comparatively low weight of the apparatus. A compact shape and a comparatively low weight promote the comfort of use because a user can then easily maneuver the apparatus around his/her head him/herself. An additional advantage of this embodiment is that substantially the entire length of the winding part is utilized for heat transfer to both the evaporation channel and the distribution channel.

It is favorable when the heating element is a heat source in a rod-shaped heat conductor which has grooves provided in the longitudinal direction, which grooves each bound an evaporation channel. The rod-shaped heat conductor has a high heat capacity, so that much heat can be transmitted in a short time while a heat source of low power is used. This renders a comparatively fast and high heat transmission possible during operation, which is advantageous for a comparatively fast generation of steam in the evaporation channels and is thus favorable for applying steam to the lock of hair in pulses. The heating element is efficiently utilized for forming evaporation channels, for heating of water to generate steam in these evaporation channels, and for keeping the distribution channel at a comparatively high temperature. This integration of functions in one component offers the possibility of dispensing with alternative components, facilitating the manufacture and assembly, and achieving a low cost price.

It is furthermore favorable when a number of distribution channels are present which are provided at substantially equal mutual interspacings as viewed in a circumferential direction of the winding part. In this manner, the steam is evenly distributed over the circumference of the winding part, and accordingly over the lock of hair wound around the winding part, through the distribution channels during operation, which contributes to a good hairstyling result.

There are various possibilities for covering the grooves so as to delimit the evaporation channels. Thus an embodiment of the apparatus according to the invention is characterized in that the heating element has covering elements around the rod-shaped heat conductor, which elements each cover two grooves and have a fold between the two grooves with openings belonging to the steam outlet, said fold delimiting a distribution channel. Such an embodiment of the apparatus offers the possibility of a ready manufacture and assembly and a low cost price.

An alternative embodiment of the apparatus according to the invention is characterized in that the heating element comprises a tubular covering element which is in thermal contact with the heat conductor, which covers the grooves, which extends in the longitudinal direction around the rod-shaped heat conductor, and which has pairs of walls projecting outwards and extending in the longitudinal direction, which pairs each delimit a distribution channel. The distribution channels are thus integrated into one component, which integration offers the possibility of a ready manufacture and assembly and a low cost price.

Another embodiment of the apparatus according to the invention is characterized in that the heating element comprises a tubular covering element which is in thermal contact with the heat conductor, which covers the grooves, which extends in the longitudinal direction around the rod-shaped heat conductor, and which comprises folds which extend in the longitudinal direction between at least part of the grooves, which project outwards, which have openings belonging to the steam outlet, and which each delimit a distribution channel. Such an embodiment again offers the possibility of a ready manufacture and assembly and a low cost price on account of its integration.

It is favorable when the exit of the evaporation channel is connected to an entrance of the distribution channel via a water separator which comprises a chamber which is in thermal contact with the heating element and into which the evaporation channel issues, and which comprises a steam guide which extends to inside said chamber and to which the entrance of the distribution channel is connected. Any water drops from the evaporation channel which have still remained after the evaporation will be caught in the chamber. Since the steam guide extends into the chamber and evaporation of the drops takes place inside the chamber, it is counteracted in many operational positions of the apparatus that the drops can reach the distribution channel.

BRIEF DESCRIPTION OF THE DRAWINGS

The apparatus according to the invention will be explained in more detail below with reference to the drawings, in which FIG. 1 diagrammatically shows an apparatus according to the invention.

DESCRIPTION OF THE PREFERRED EMBODIMENTS

Figure 1:
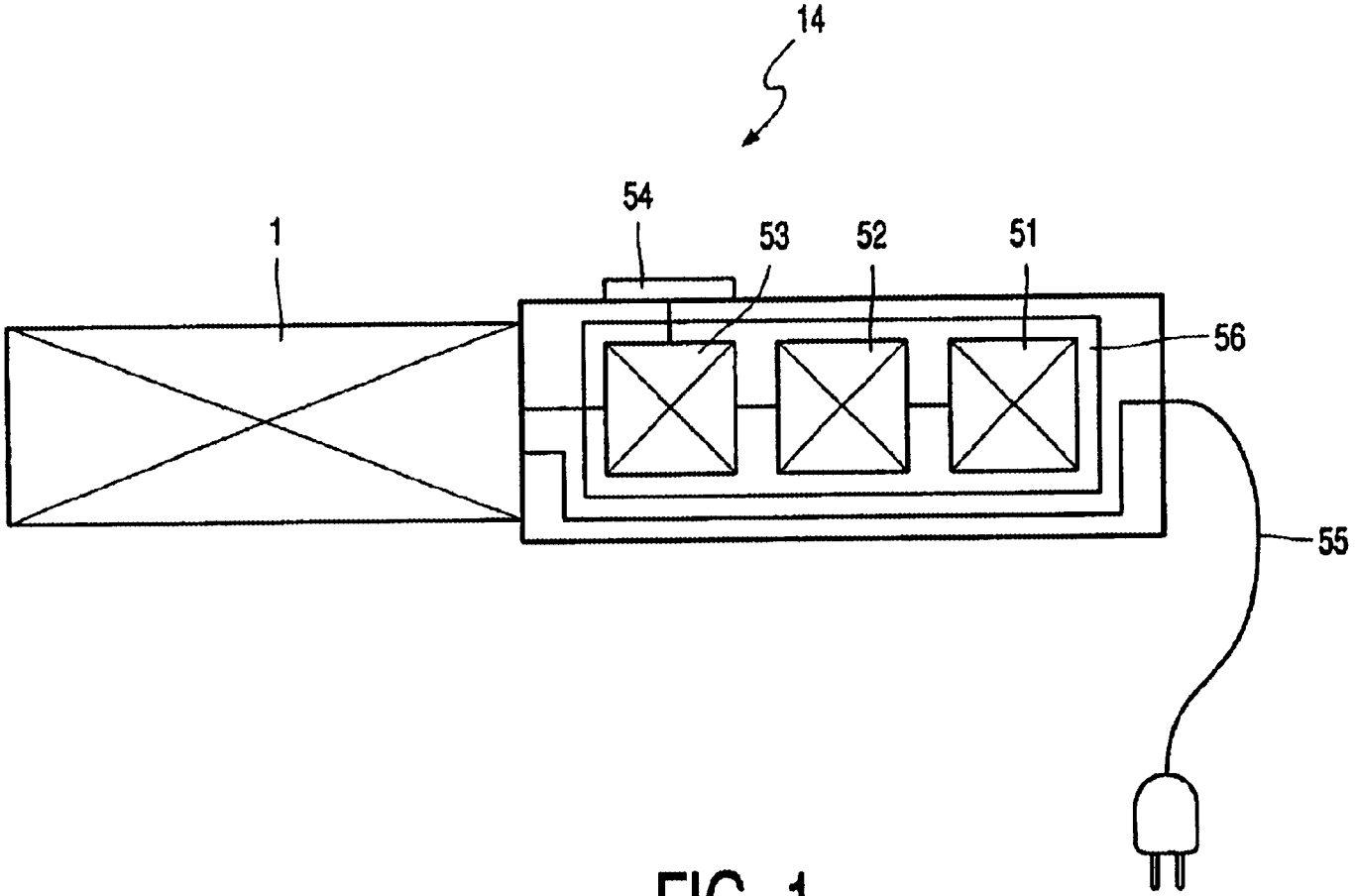

The apparatus shown diagrammatically in FIG. 1 has a winding part 1 which extends in a longitudinal direction, around which hair can be wound, and which is connected to a holder 14. The holder 14 has a water supply unit 56 which comprises a water reservoir 52, a water filling device 51, and a pump 53 which may be chosen from various known types and which are depicted diagrammatically in this Figure. It is noted that steam is applied to the hair in one or several pulses by means of the apparatus according to the invention. An operational control is for this purpose present on the apparatus, for example a button 54 which, when operated by a user, injects a given quantity of water from the holder 14 into evaporation channels inside the winding part 1. An electrical connection 55 is furthermore present for a heating element which is also arranged inside the winding part 1.

Figure 2A:
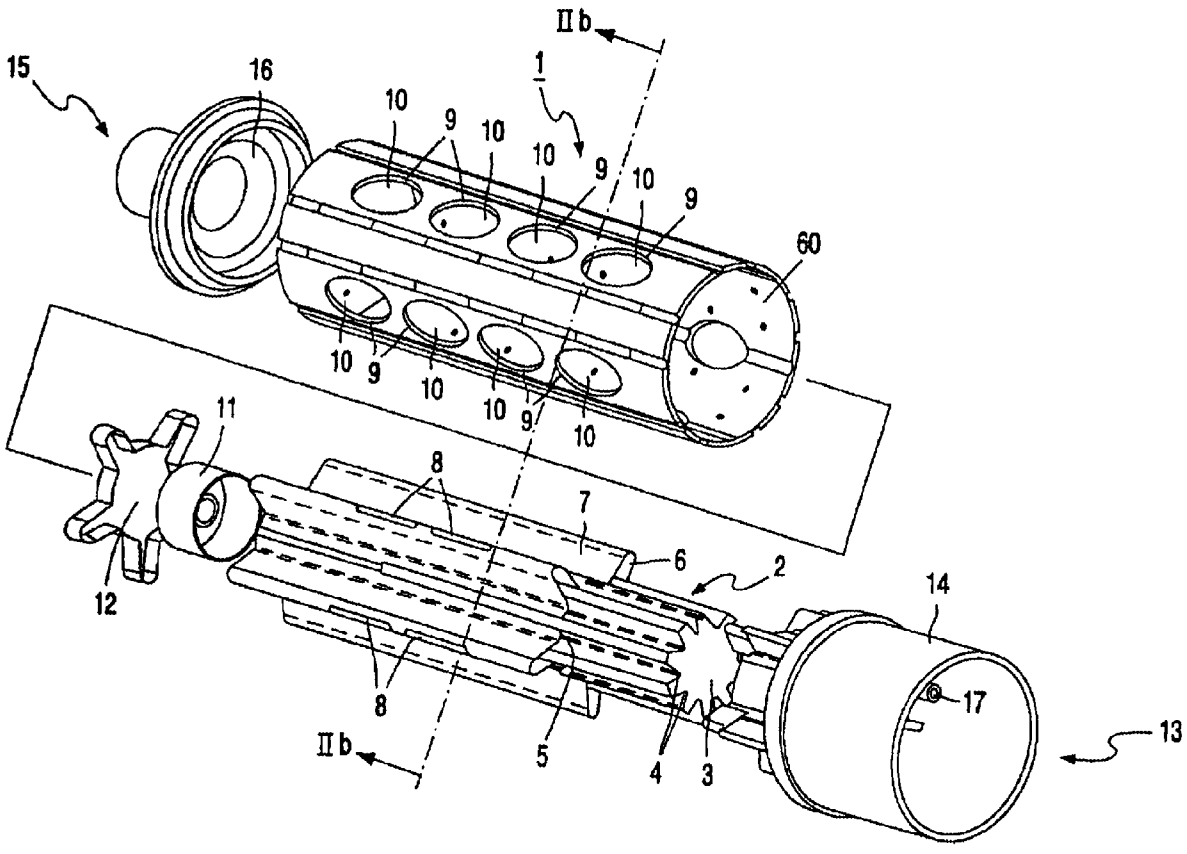
FIGS. 2*a*, 2*b*, and 2*c* show a first embodiment of a winding part of the apparatus according to the invention in an exploded view, a cross-sectional view taken on the line IIb—IIb in FIG. 2*a*, and in a longitudinal sectional view taken on the line IIc—IIc in FIG. 2*b*, respectively.

The first embodiment of the winding part 1 of the apparatus according to the invention as shown in FIG. 2*a* comprises a heating element 2 which extends in the longitudinal direction. The winding part 1 further comprises evaporation channels 5 for the generation of steam, which channels extend in the longitudinal direction, each have an exit 40, and are in thermal contact with the heating element 2. In addition, the winding part 1 comprises distribution channels 6 which extend in the longitudinal direction, which are manufactured from a thermally conducting material, and which are in thermal contact with the heating element 2 over substantially their entire length. The distribution channels 6 indicated in FIG. 2*c* connect the exits 40 of the evaporation channels 5 to a steam outlet 10 which extends in the longitudinal direction (see FIG. 2*a*). As is also visible in FIG. 2*a*, the winding part 1 in this embodiment has a cylindrical winding bush 60 with openings 9. As is visible in FIG. 2*c*, the evaporation channels 5 extend from adjacent a base 13 of the winding part 1, formed by the holder 14 here, in longitudinal direction to adjacent an end 15 of the winding part 1. The distribution channels 6 extend from the end 15 to adjacent the base 13. The heating element 2 in this embodiment is formed by an aluminum extruded part 3 serving as the heat conductor, in which a PTC element is enclosed as the heat source. The aluminum extruded part 3 is provided with grooves 4 which run in the longitudinal direction and which bound the evaporation channels 5. The distribution channels 6 are provided at substantially equal mutual interspacings, when viewed in a circumferential direction of the winding part 1. The distribution channels 6 in this embodiment are formed by covering elements 7 which are present around the aluminum extruded part 3 and are in thermal contact therewith. The covering elements 7 are folded aluminum plate parts which are each clamped on a ridge between two grooves 4 and are thus in close thermal contact with the aluminum extruded part 3. As is visible in FIG. 2*b*, each folded plate part covers two grooves 4, whereby an evaporation channel 5 is defined. In addition, each plate part forms a fold between the two grooves 4, which folds delimits a distribution channel 6. Distribution channel openings 8 are present in each fold and are in communication with the openings 9 in the winding part 1, thus forming the steam outlet 10 in this embodiment. The apparatus further comprises a water separator 11 which in this embodiment is arranged between the exits 40 of the evaporation channels 5 and a distributor cap 12. The distributor cap 12 is connected to entrances 41 of the distribution channels 6 for the distribution of steam from the water separator 11 over the various distribution channels 6. This embodiment further comprises an end cover 16 which is present at the end 15 of the winding part 1 and which covers the distributor cap 12 and the water separator 11. The holder 14 has a water inlet 17 for the supply of water necessary for generating steam in the winding part 1, which water inlet connects the evaporation channels 5 via an annular channel 29 to the water supply unit 56 diagrammatically depicted in FIG. 1.

Figure 2C:
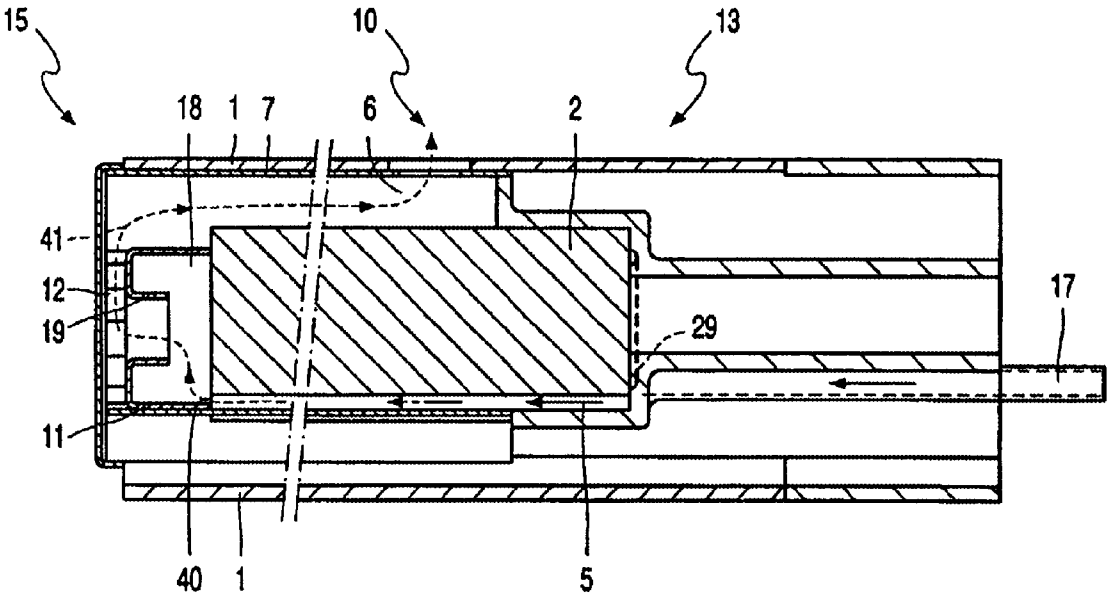

As is visible in FIG. 2*c*, a given quantity of water is transported from the water inlet 17 to the evaporation channels 5 during operation. The water flow is indicated with a continuous arrow in the Figure. The water is converted into steam through heating by the heating element 2 in the evaporation channels 5, which water-steam conversion is indicated in the Figure with a partly drawn, partly broken-line arrow. Then the steam, indicated with a broken-line arrow in the Figure, reaches a chamber 18 of the water separator 11. A steam guide 19 extends to inside the chamber 18, with the result that any water drops remaining after the evaporation are caught in a space around the steam guide in the chamber 18 until they, too, have evaporated owing to the thermal contact between the water separator 11 and the heating element 2. It is prevented thereby that drops enter the distribution channels 6 in various operational positions of the apparatus. The steam subsequently leaves the water separator 11 through the steam guide 19 and is distributed over the distribution channels 6 by the distributor cap 12. Then the steam reaches the steam outlet 10 through the distribution channels 6 and penetrates the lock of hair which is wound around the winding part 1. The distribution channels 6 are manufactured from a thermally conducting material, aluminum in this embodiment, and are in thermal contact with the heating element over substantially their entire length, so that condensation of water in the distribution channels 6 during transport of the steam from the entrances 41 of the distribution channels to the steam outlet 10 is counteracted. The distribution channel openings 9 are also in thermal contact with the heating element 2 because they form part of the distribution channels 6, so that condensation of steam at these openings is also counteracted. It is prevented thereby that water drops can drop from the winding part through the wound lock of hair onto the skull during hairstyling, which benefits the comfort of use and the safety of the apparatus.

Figure 2B:
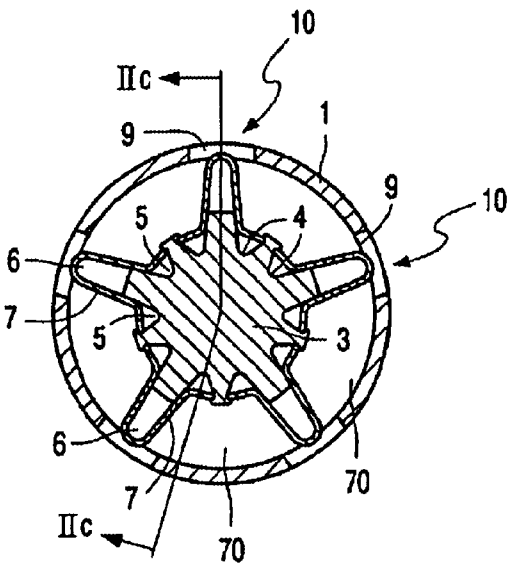
Figure 3A:
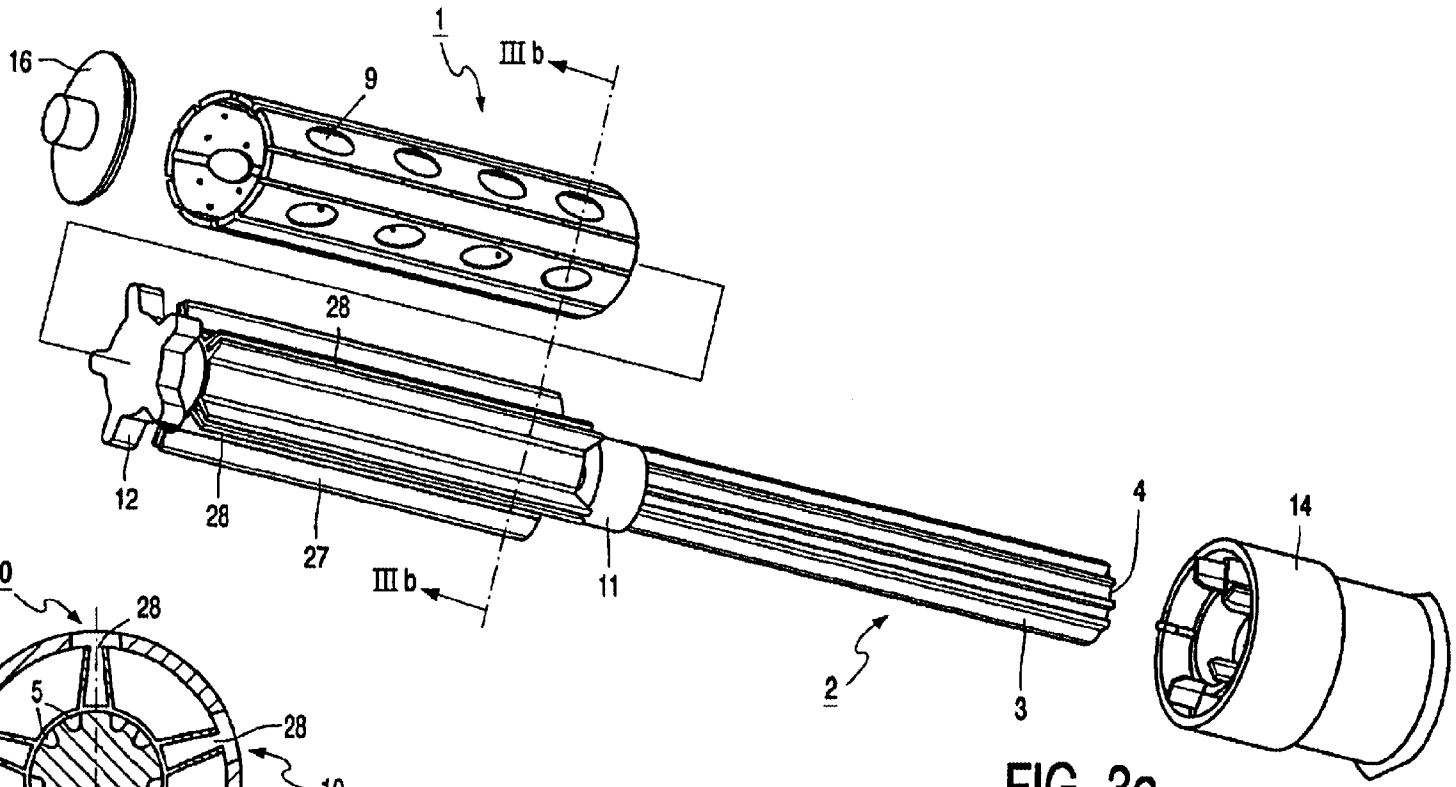
FIGS. 3*a* and 3*b* show a second embodiment of a winding part of the apparatus according to the invention in an exploded view and a cross-sectional view taken on the line IIIb—IIIb in FIG. 3*a*, respectively.
Figure 3B:
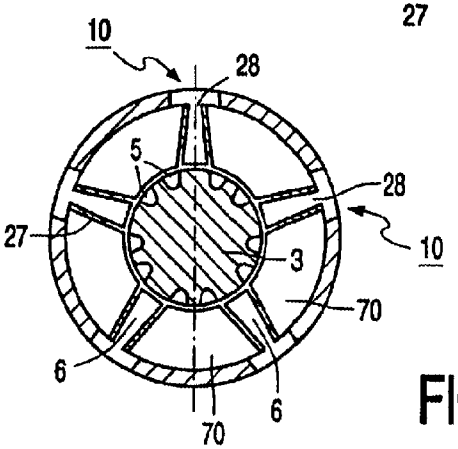

FIGS. 3*a* and 3*b* show a second embodiment of the apparatus according to the invention in which a covering element 27 is used in a manner described below instead of the covering elements 7 of the first embodiment shown in FIGS. 2*a*, 2*b*, and 2*c*. The second embodiment of the apparatus according to the invention further comprises substantially the same components as the first embodiment and has a similar operation. Corresponding components of the first and the second embodiment have been given the same reference numerals in FIGS. 3*a* and 3*b*. The tubular covering element 27 extending in the longitudinal direction and shown in FIGS. 3*a* and 3*b* is an extruded part of substantially stellar cross-section which is provided around the heating element 2 and is in thermal contact therewith. Each distribution channel 6 is bounded by a pair of (i.e. two) walls which extend in the longitudinal direction and project outwards. These walls thus define a passage 28 which extends in the longitudinal direction. The passage 28 is in communication with the openings 9 in the winding part 1 and thus forms the steam outlet 10 in this embodiment. The evaporation channels 5 and the distribution channels 6 are formed by just a single covering element manufactured as one integral part in this embodiment. This favors an easy manufacture and assembly and can thus contribute to a low cost price of the apparatus.

Figure 4A:
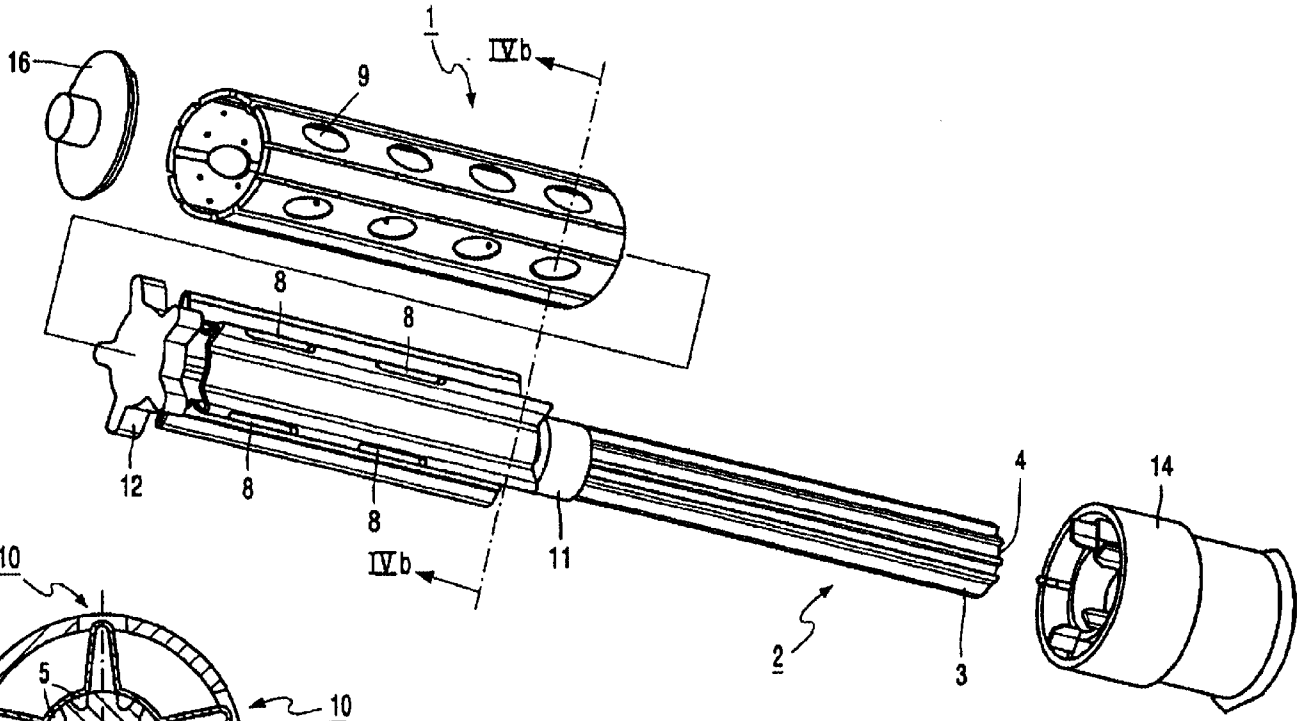
FIGS. 4*a* and 4*b* show a third embodiment of a winding part of the apparatus according to the invention in an exploded view and in a cross-sectional view taken on the line IVb—IVb in FIG. 4*a*, respectively.
Figure 4B:
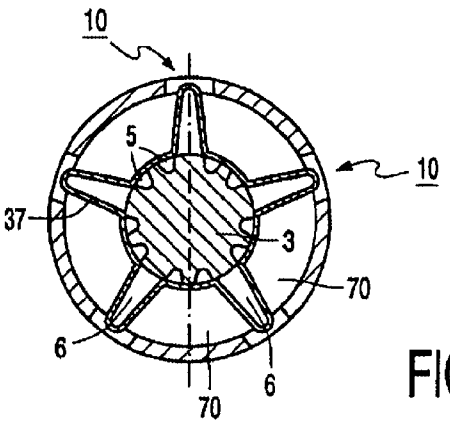

FIGS. 4*a* and 4*b* show a third embodiment of the apparatus according to the invention in which a covering element 37 to be described below is utilized instead of the covering elements 7 of the first embodiment shown in FIGS. 2*a*, 2*b*, and 2*c*. The third embodiment of the apparatus according to the invention further comprises substantially the same components again as the first embodiment and has a similar operation. Corresponding components of the first and the third embodiment have again been given the same reference numerals in FIGS. 4*a* and 4*b*. The tubular covering element 37 extending in the longitudinal direction and shown in FIGS. 4*a* and 4*b* is a part of substantially stellar cross-section which is provided around the heating element 2 and is in thermal contact therewith. Each distribution channel 6 is bounded by a fold which extends in the longitudinal direction, which projects to the outside, and which has distribution channel openings 8. The distribution channel openings 8 are in communication with the openings 9 in the winding part 1 and thus form the steam outlet 10 in this embodiment. In this embodiment, again, there is only one covering element manufactured as one integral whole which forms the evaporation channels 5 and the distribution channels 6. This benefits the ease of manufacture and assembly and can thus contribute to a favorable cost price of the apparatus.

It is noted that it is alternatively possible to use a combination of steam and air for the purpose of hairstyling in the apparatus according to the invention. This may be realized, for example, by means of an electrical air supply unit next to the water supply unit pictured in FIG. 1, with a control such as a second button in the holder 14. This electrical air supply unit will then be connected to the spaces between the inner wall of the winding bush 60 and the outer wall of the covering elements 7, 27, 37 in the various embodiments, which spaces form air channels 70, as is visible in FIGS. 2*b*, 3*b* and 4*b*. Said air channels 70 are in communication with the openings 9 in the winding part 1. A steam pulse is applied to the lock of hair wound around the winding part 1 when the button for water injection is pressed by the user. Several steam pulses are applied when the button is pressed several times. Then the user operates the second button for air supply, whereupon the lock of hair is dried with cold air. This is favorable for a good hairstyling result. In an alternative embodiment, a supply of hot air takes place to the lock of hair wound around the winding part, said air being heated by the heating element. The lock of hair is thus dried with hot air.

It is furthermore noted that the longitudinal direction in which certain components are said to extend in the above description and in the claims is the main direction in which these components extend. This does not exclude the possibility of components which extend in the longitudinal direction having, for example, a helical shape.

What is claimed is:

1. An apparatus for hairstyling with the aid of steam, comprising:

a winding part extending in a longitudinal direction, said winding part being arranged such that hair can be wound around the winding part, and said winding part comprising:

a heating element extending in the longitudinal direction;

an evaporation channel for generating steam, extending in the longitudinal direction to an exit, and being in thermal contact with said heating element;

a steam outlet extending in the longitudinal direction; and a distribution space which connects the exit of the evaporation channel to the steam outlet, wherein the distribution space comprises a distribution channel which extends in the longitudinal direction, said distribution channel being formed of a thermally conductive material and being in thermal contact with the heating element over substantially the entire length of the distribution channel.

2. The apparatus claimed in claim 1 comprising a water separator having a chamber which is in thermal contact with the heating element, wherein the exit of the evaporation channel opens into said chamber, and said water separator includes a steam guide which extends to inside the chamber and which connects to an entrance of the distribution channel, whereby the evaporation channel communicates with the distribution channel via said water separator.

3. The apparatus claimed in claim 1, wherein the heating element comprises a heat source disposed in a rod-shaped heat conductor, said heat conductor having a plurality of grooves extending longitudinally, each groove bounding a respective evaporation channel.

4. The apparatus claimed in claim 1, wherein the distribution space comprises a plurality of mutually, and substantially equally, spaced longitudinally extending channels around the circumference of the winding part.

5. The apparatus claimed in claim 4, wherein:

the heating element comprises a beat source disposed in a rod-shaped heat conductor, said heat conductor having a plurality of grooves extending longitudinally, each groove bounding a respective evaporation channel, and said heating element comprises a plurality of covering elements formed of a thermally conductive material and disposed around said heat conductor, each covering element covering a respective two said grooves and having a fold between the two grooves, each fold delimiting a distribution channel and having a plurality of said steam outlets.

6. The apparatus claimed in claim 4, wherein:

the heating element comprises a heat source disposed in a rod-shaped heat conductor, said heat conductor having a plurality of grooves extending longitudinally, each groove bounding a respective evaporation channel, and said heating element comprises a tubular covering element formed of a thermally conductive material and disposed in thermal contact with said heat conductor, said covering element covering said grooves and having pairs of walls projecting outwardly and extending in the longitudinal direction, each pair of walls delimiting a respective distribution channel.

7. The apparatus claimed in claim 4, wherein:

the heating element comprises a heat source disposed in a rod-shaped heat conductor, said heat conductor having a plurality of grooves extending longitudinally, each groove bounding a respective evaporation channel, and said heating element comprises a plurality of covering elements disposed around said heat conductor, each covering element covering a respective two said grooves and having a fold between the two grooves, each fold delimiting a distribution channel and having a plurality of said steam outlets.

8. The apparatus claimed in claim 1, wherein the evaporation channel extends from a location adjacent a base of the winding part to said exit at a location adjacent an end of the winding part, and the distribution channel extends from a location adjacent said end of the winding part to a location adjacent said base.

9. The apparatus claimed in claim 8, wherein the heating element comprises a heat source disposed in a rod-shaped heat conductor, said heat conductor having a plurality of grooves extending longitudinally, each groove bounding a respective evaporation channel.

10. The apparatus claimed in claim 8, wherein the distribution space comprises a plurality of mutually, and substantially equally, spaced longitudinally extending channels around the circumference of the winding part.

11. The apparatus claimed in claim 10, wherein:

the heating element comprises a heat source disposed in a rod-shaped heat conductor, said heat conductor having a plurality of grooves extending longitudinally, each groove bounding a respective evaporation channel, and said heating element comprises a plurality of covering elements formed of a thermally conductive material and disposed around said heat conductor, each covering element covering a respective two said grooves and having a fold between the two grooves, each fold delimiting a distribution channel and having a plurality of said steam outlets.

12. The apparatus claimed in claim 10, wherein:

the heating element comprises a heat source disposed in a rod-shaped heat conductor, said heat conductor having a plurality of grooves extending longitudinally, each groove bounding a respective evaporation channel, and said heating element comprises a tubular covering element formed of a thermally conductive material and disposed in thermal contact with said heat conductor, said covering element covering said grooves and having pairs of walls projecting outwardly and extending in the longitudinal direction, each pair of walls delimiting a respective distribution channel.

13. The apparatus claimed in claim 10, wherein:

the heating element comprises a heat source disposed in a rod-shaped heat conductor, said heat conductor having a plurality of grooves extending longitudinally, each groove bounding a respective evaporation channel, and said beating clement comprises a plurality of covering elements disposed around said heat conductor, each covering element covering a respective two said grooves and having a fold between the two grooves, each fold delimiting a distribution channel and having a plurality of said steam outlets.

* * * * *